US005286953A

United States Patent [19]

Marvonek et al.

[11] Patent Number: 5,286,953

[45] Date of Patent: Feb. 15, 1994

[54] CARBURETOR JET SELECTION TOOL

[76] Inventors: Michael F. Marvonek; Patricia Marvonek, both of P.O. Box 232, Stafford Springs, Conn. 06076

[21] Appl. No.: 933,792

[22] Filed: Aug. 24, 1992

[51] Int. Cl.[5] ..... G06C 27/00

[52] U.S. Cl. ..... 235/78 R; 235/83; 235/88 R

[58] Field of Search ..... 235/83, 84, 88 R, 88 RC, 235/78 R; D18/10

[56] References Cited

U.S. PATENT DOCUMENTS

| | | | |
|---|---|---|---|
| D. 221,185 | 7/1971 | Gluck et al. | D18/10 |
| 2,307,967 | 1/1943 | Stevenson | 235/88 R |
| 2,586,058 | 2/1952 | Knopke | 235/83 |
| 3,434,658 | 3/1969 | Goldstein | 235/84 |
| 4,359,629 | 11/1982 | Sheppard | 235/83 |
| 4,520,668 | 6/1985 | Allemano | 235/83 |

*Primary Examiner*—Michael L. Gellner
*Assistant Examiner*—Eddie C. Lee
*Attorney, Agent, or Firm*—Robert S. Smith

[57] ABSTRACT

An apparatus for identifying the optimum jet for a carburetor which includes a general annular first member having a plurality of first graduations disposed about a peripheral portion thereof, a general arcuate second member having a plurality of second graduations disposed for cooperation with the first graduations, and members coupling the first and second member permitting relative rotation and selective alignment of the first and second graduations. One of the plurality of graduations are arrayed on a linear scale corresponding to relative air density and the other of the plurality of graduations being arrayed on a scale corresponding to respective jet flow and or identifying numbers. The members coupling the first and second members may include a plurality of arms disposed at angularly space intervals. There may be three such arms and they may be fixed to the arcuate member. The annular member may include an offset peripheral portion that is nested between with the three arms.

2 Claims, 3 Drawing Sheets

CARBURETOR JET SELECTION TOOL

BACKGROUND OF THE INVENTION

The invention relates to apparatus for optimizing the performance of internal combustion engines equipped with a carburetor and particularly for selecting the optimum main jet or nozzle for a carburetor.

The selection of the nozzles or jets for a carburetor used with an internal combustion engine has a marked impact on the performance of the engine. More specifically, the fuel economy, top speed and the vehicle acceleration are markedly influenced by the nozzle selection. The conventional carburetor does not vary fuel delivered to the engine when the air density changes.

A reciprocating internal combustion engine draws the same volume of air during the intake stroke despite the ambient conditions. The weight and density of the air drawn into the cylinder will vary substantially with atmospheric pressure and temperature.

Relative air density gauges have been employed with various engines. One common application is in the stock car racing field although the apparatus is also commonly used for sprint cars, snowmobiles, go carts, and motorcycles. A typical relative air density gauge has a small bellows with air sealed inside the bellows. An increase in air pressure compresses the bellows which is coupled to a needle that is mounted for rotation. Higher atmospheric pressure compresses the bellow and causes the movement of the needle to a higher level on an arcuate scale. Lower atmospheric pressure allows the bellows to expand and causes the needle coupled to the to the bellows to move to a lower position on an arcuate scale. Similarly, cooling of the ambient air cools the air in the bellows and this causes the bellows to contract which results in a higher indication on the scale by the needle. Heating of the ambient air causes the heating of the air within the bellows and this causes the bellows to expand which results in a lower indication on the scale by the needle.

Those skilled in the art will recognize that if the density of the air increases and the quantity of fuel supplied to the engine is constant, the mixture will be lean. This will cause a power loss and could damage the engine. Addition of the optimum amount of fuel, by using a larger jet or nozzle results in a power increase and less risk of engine damage.

The utilization of the air density gauge involves a calculation or trial and error to optimize the jet or jets for the carburetor. Many people are not comfortable with making a mathematical calculation to determine the correct jet size.

It is an object of the invention to provide a construction that will enable even mathematically unsophisticated users to more precisely determine the correct jet or nozzle size.

It is an object of the invention to provide apparatus that will physically cooperate with an associated relative air density gauge.

It is an object of the invention to provide apparatus which is inexpensive to manufacture.

Still another object of the invention is to provide apparatus that may be mounted in a manner that will facilitate use of the apparatus.

SUMMARY OF THE INVENTION

It has now been found that these and other objects of the invention may be attained in an apparatus for identifying the optimum jet for a carburetor which includes a general annular first member having a plurality of first graduations disposed about a peripheral portion thereof, a general arcuate second member having a plurality of second graduations disposed for cooperation with the first graduations, and means coupling the first and second member permitting relative rotation and selective alignment of the first and second graduations. One of the plurality of graduations are arrayed on a linear scale corresponding to relative air density and the other the plurality of graduations being arrayed on a scale corresponding to respective jet identifying numbers.

In some forms of the invention the means for coupling the first and second members includes a plurality of arms disposed at angularly space intervals. There may be three such arms and they may be fixed to the arcuate member. The annular member may include an offset peripheral portion that is nested within the three arms.

In some cases the annular member may be dimensioned and configured to fit around the circumference of an associated relative air density gauge.

BRIEF DESCRIPTION OF THE DRAWING

The invention will be better understood by reference to the accompanying drawing in which.

DESCRIPTION OF THE PREFERRED EMBODIMENT

Figure 1:
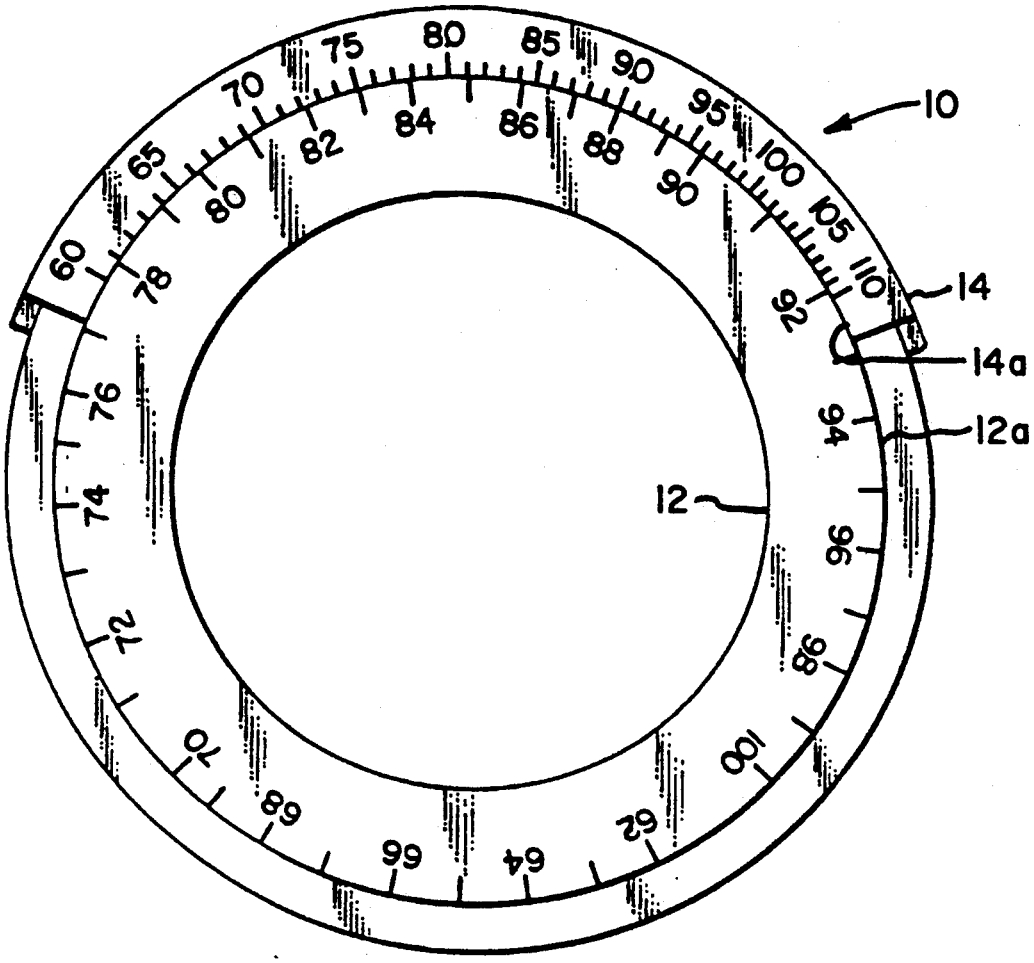
FIG. 1 is a front elevational view of a tool in accordance with one form of the invention.
Figure 2:
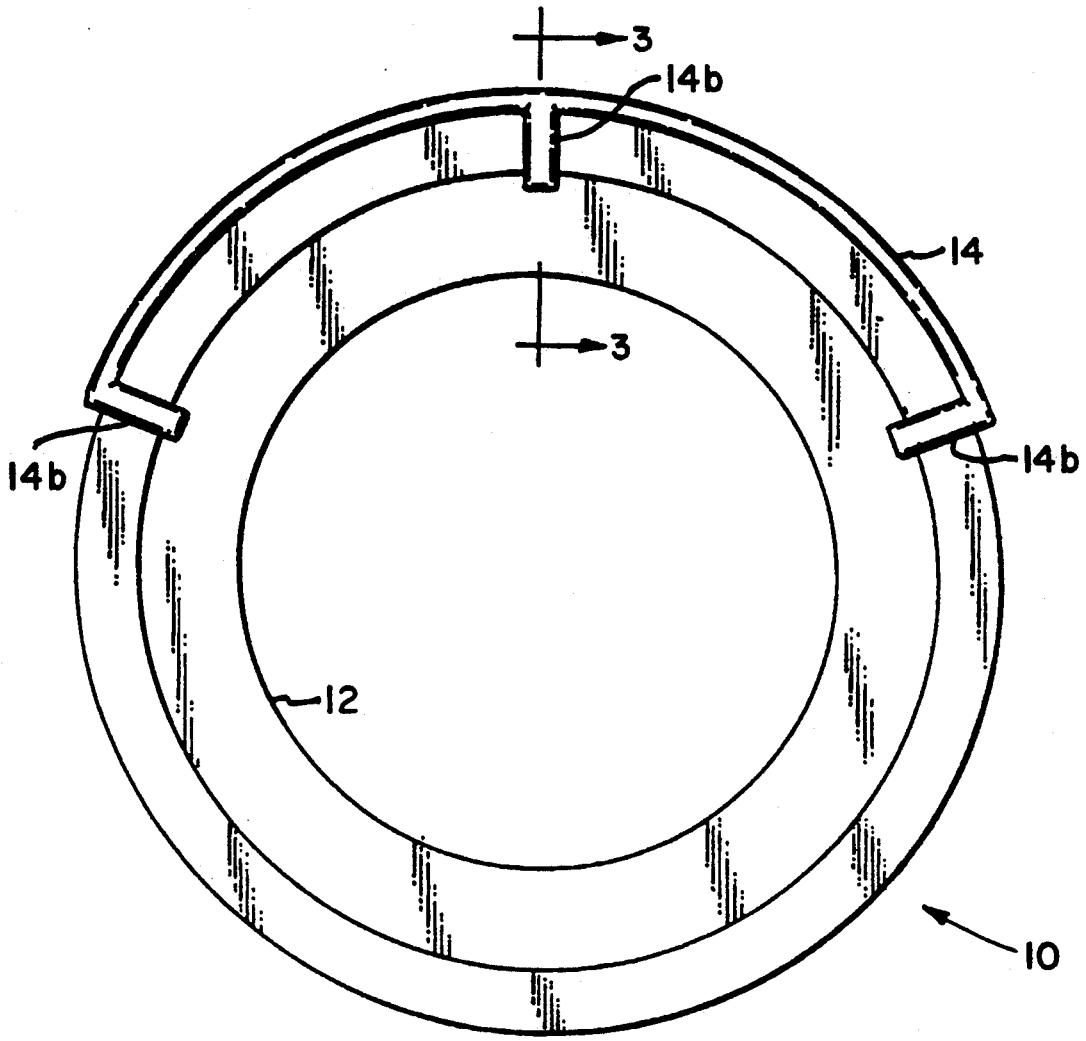
FIG. 2 is rear elevational view of the apparatus shown in FIG. 1.
Figure 3:
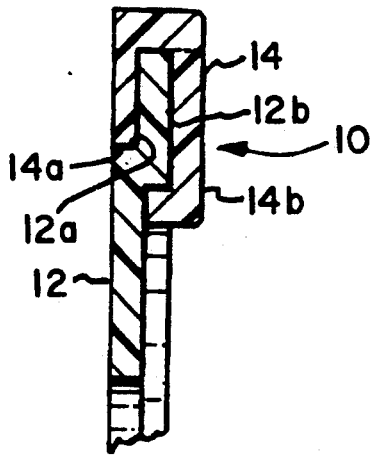
FIG. 3 is a fragmentary sectional view taken along the line 3—3 of FIG. 2.

Referring now to FIGS. 1-3 there is shown a jet selection tool 10 in accordance with one form of the invention. The tool 10 includes an inner annular member 12 and an outer arcuate member 14. The members 12, 14 are dimensioned and configured to permit relative sliding movement.

As will be seen from the drawing that the arcuate member 14 has an arcuate edge 14*a* that bears throughout the extent thereof on the circular edge 12*a* of the member 12. In other words the circular edge 14*a* and the circular edge 12*a* are abutting and have the same center of curvature. In the preferred embodiment the member 14 includes three arms 14*b* that clamp the outer arcuate member 14 to the inner annular member.

As best seen in FIG. 3 the inner annular member 12 is generally planar and has an offset radially extending generally planar lip or peripheral portion 12*b* that is nested between the three arms 14*b* and the front face of the outer arcuate member 14. The lip 12*b* and the annular member 12 are parallel.

Disposed on the inner annular member 12 adjacent to the edge 12*a* thereof is a plurality of graduations that represent industry standard numbers for jets for a specific carburetor, such as a Holley carburetor. The industry standard practice is to use integer numbers for a plurality of industry standard nozzle or jet sizes for a given carburetor. The spacing of the graduations is selected to be a function of the fuel flow through the respective nozzles. Because of the manner in which the industry standard identifying numbers for nozzles or jets have been chosen the scale on the inner arcuate member is not linear. Those skilled in the art will recognize that trade publications provide information as to the flow through any of the standard nozzles designated by industry standard numbers. In the preferred embodiment a change of 1% in the fuel flow corresponds to 2 degrees. For example, a change of fuel flow from 300 cc/min. to 318 cc/min. is a change of 6% which corresponds to an angular sector of 12 degrees.

Disposed on the outer arcuate member 14 are a plurality of graduations corresponding to relative air densities, expressed in percentage, obtained from an associated gauge. Those skilled in the art will recognize that the relative air density is derived from a relative air density gauge that typically read 100% at 59 degrees F. and an atmospheric pressure of 29.92 inches of mercury. Accordingly the other graduations on the edge 14*a* correspond to a percentage of the density at these particular conditions. In a typical embodiment of invention a change of 1% in the relative air density corresponds to an angular sector of 2 degrees. For example, a change from 50% to 51% is a 2% increase and the spacing is accordingly 4 degrees.

The user of the apparatus in accordance with the invention will typically be used by running an engine at wide open throttle to find the optimum main jet. Starting with large jets the user decreases the size of the jet selected while checking the spark plugs, pistons, exhaust gas temperatures, etc. to get the best mixture for acceleration, top speed and power. When this jet selection has been made the user aligns the number of the jet with the current relative air density gauge reading. After that the user will not move the position of the member 14 with respect to the member 12 to determine the jet or nozzle for another relative air density. Thereafter, the user merely needs to read the relative air density gauge and then observe the jet or nozzle number on the scale of member 12 that is aligned with the current relative air density on the member 14.

It will be understood that each apparatus 10 is configured for a specific carburetor. Different graduations on the annular member 12 will ordinarily be required for jets or nozzles made by different manufacturers and, in some cases, even for different jets or nozzles made by the same manufacturer.

Figure 4:
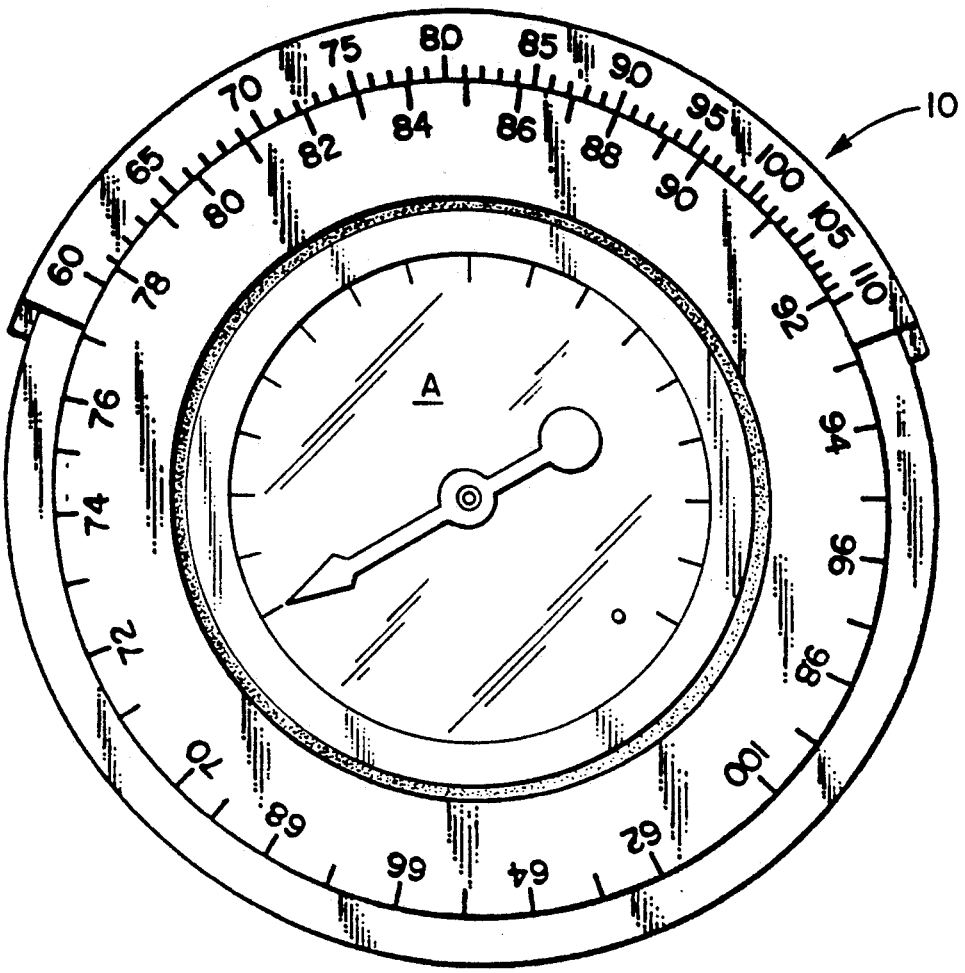
FIG. 4 is a front elevational view of the apparatus of FIG. 1 installed on an associated air density gauge.

As shown in FIG. 4, the annular member 12 is preferably dimensioned to fit snugly over the outer diameter of an associated relative air density gauge A to further increase the utility of the apparatus 10. Accordingly, the user may leave the apparatus 10 secured on the associated relative air density gauge A.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention we claim:

1. Apparatus for identifying the optimum jet for a carburetor which includes:

a general annular first member having a plurality of first graduations disposed about a peripheral portion thereof;

a general arcuate second member having a plurality of second graduations, said second member being disposed for cooperation with said first plurality of graduations;

means coupling said first and second members permitting relative rotation and selective alignment of said first and second pluralities of graduations;

one of said pluralities of graduations being arrayed on a linear scale corresponding to relative air density; and the other of said pluralities of graduations being arrayed with nonlinear spacing therebetween and corresponding to respective jet identifying numbers and said means for coupling said first and second members includes a plurality of arms disposed at angularly space intervals; said plurality of arms being fixed to said arcuate member; said annular member includes an offset generally planar radially extending peripheral portion that is nested within said arms, said offset generally planar radially extending peripheral portion being substantially parallel to said annular member, said annular member being dimensioned and configured to fit around the circumference of an associated relative air density gauge.

2. The apparatus as described in claim 1 wherein:

said one of said plurality of graduations arrayed on a linear scale corresponding to relative air density having graduations spaced on an arcuate scale with a ratio of 2 degrees to a change of 1% in fuel flow.

* * * * *